US005427437A

United States Patent [19]

Lacasse

[11] Patent Number: 5,427,437

[45] Date of Patent: Jun. 27, 1995

[54] PERMANENT SEAT BRACKET AND BENCH

[76] Inventor: Norman Lacasse, 118 Roosevelt St., Bridgeport, Conn. 06608

[21] Appl. No.: 180,902

[22] Filed: Jan. 12, 1994

[51] Int. Cl.[6] ..... A47C 7/02

[52] U.S. Cl. ..... 297/452.21; 297/446

[58] Field of Search ..... 297/446, 452.21, 452.24, 297/452.63, 440.18, 440.19, 440.23

[56] References Cited

U.S. PATENT DOCUMENTS 861,454 7/1907 Garrison ..... 297/446
2,374,837 5/1945 Rush ..... 297/446
2,664,149 12/1953 Howard ..... 297/452.21
2,994,558 8/1961 Draxler ..... 297/446

FOREIGN PATENT DOCUMENTS 1036268 9/1953 France ..... 297/440.23
8402 of 1894 United Kingdom ..... 297/446

*Primary Examiner*—Laurie K. Cranmer
*Attorney, Agent, or Firm*—Patrick J. Walsh

[57] ABSTRACT

A seat bracket includes front and rear upright members together with crosspieces for supporting back rest slats and seat slats. The upright and crosspieces are contoured to provide a comfortable seat surfaces when the brackets and slats are assembled into a completed bench.

8 Claims, 2 Drawing Sheets

PERMANENT SEAT BRACKET AND BENCH

BACKGROUND OF THE INVENTION

The present invention relates to seat brackets which may be attached to a wall or handrail support, or may stand alone. Two or more brackets in assembly with back and seat slats form a bench of robust durable construction suitable for outdoor use in all seasons.

SUMMARY OF THE INVENTION

The present invention comprises a permanent seat bracket designed to attach to any wall or hand rail support, or to stand alone. In a preferred form of the invention, the seat bracket comprises front and back vertical members fabricated of standard lumber and horizontal pieces constructed of custom contoured standard lumber sizes. The horizontal pieces and the vertical pieces are fastened to each other in the form of a seat bracket. Two or more spaced seat brackets support an elongated seat member for one or more persons.

The seat bracket according to the invention is particularly suited for outdoor use on household porches and patios, as well as commercial, private, and public establishments for accommodating people on outings, picnics, and so forth.

OBJECTS OF THE INVENTION

It is an object of the invention to provide seat bracket for use in building a seat or bench primarily for out door use.

It is an object of the invention to provide a seat bracket formed of standard lumber components for making a comfortable seat or bench.

It is a further object of the invention to provide a seat bracket for building a bench which may stand alone or may be affixed to an existing structure such as a porch or building.

It is a further object of the invention to provide a seat bracket for enabling a householder, for example, to custom fit one or more benches outdoors on a patio, porch, and the like using commercial size lumber with minimal need for woodworking.

Other and further objects of the invention will occur to one skilled in the art with an understanding of the following detailed description of the invention or upon employment of the invention in practice.

DESCRIPTION OF THE DRAWING

A preferred embodiment of the invention has been chosen for purposes of illustrating the construction and operation of the invention and is shown in the accompanying drawing in which.

DETAILED DESCRIPTION OF THE INVENTION

Figure 1:
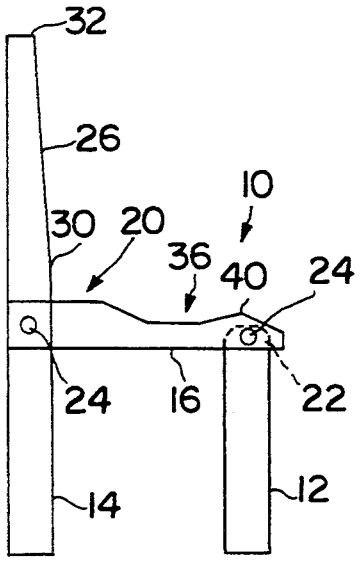
FIG. 1 is a side elevation of the seat bracket according to the invention
Figure 2:
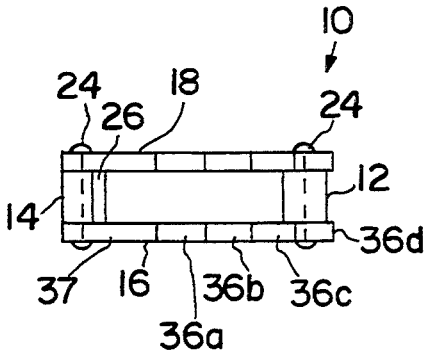
FIG. 2 is a top view thereof
Figure 3:
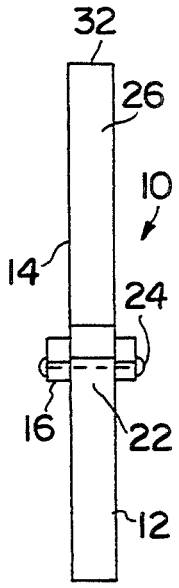
FIG. 3 is a front elevation view thereof
Figure 4:
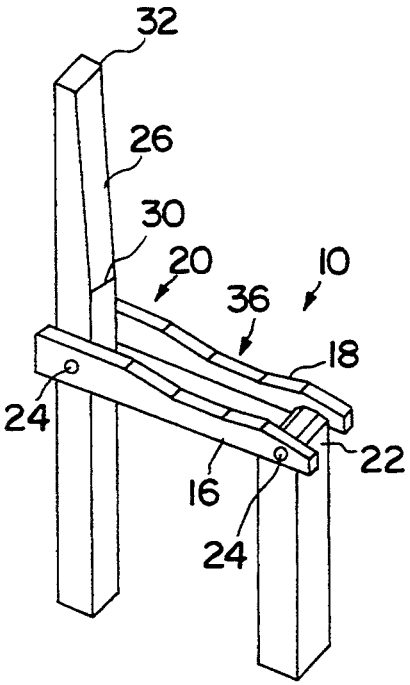
FIG. 4 a perspective view thereof

Referring now to the drawing, the seat bracket 10 according to the invention comprises spaced front 12 and rear 14 upright structural members fabricated of commercially available lumber such as 4 by 4's. A pair of horizontally extending cross pieces or seat supports 16, 18 are affixed at mid point 20 to the rear upright and at the top 22 of the front upright by suitable fasteners 24 such as bolts. The seat supports are fabricated of commercial size lumber such as 2 by 4's. The bolts pass through both the uprights and the seat supports and provide a robust seat bracket for fabricating a bench member.

The inside surface 26 of the rear upright is beveled beginning at a location 30 just above midpoint and extending to the top 32 of the upright. Preferably, the bevel is approximately 10 degrees from vertical and provides a rearward incline for back slats 34 (FIGS. 5 and 6) forming the back support of an assembled bench.

Each crosspiece 16, 18 is provided with a compound surface 36 contour from rear to front for receiving seat slats 38 (FIGS. 5 and 6) and for providing an orientation of the seat slats so as to provide a very comfortable seat. The compound surface extends forward from the top surface 37 of each cross piece and includes a first forwardly and downwardly inclined section **36*a*, a central generally horizontal section 36*b*, a forwardly and upwardly inclined section 36*c*, and terminates in a forwardly and downwardly inclined section 36*d*. The third 36*c* and last 36*d* sections form a peak 40 located approximately midway between the level of top surface 42 and the level of central section 36*b* of the crosspiece. The terminal section 36*d* ends at a point 44 below the level of the central section 36*b*. Each section 36** *a–d* of the compound surface has adequate dimensions measured rear to front to accommodate the side of a 2×4 slat.

Figure 5:
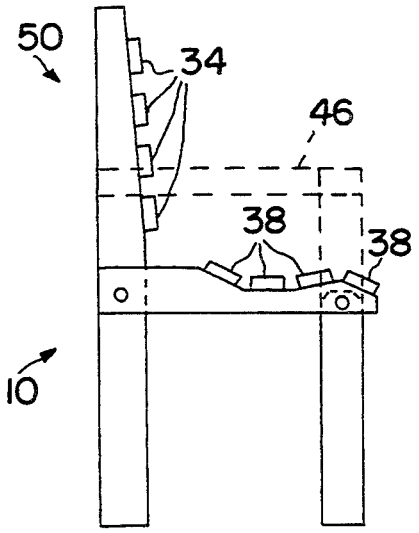
FIG. 5 is a side elevation of a bench made with seat brackets according to the invention
Figure 6:
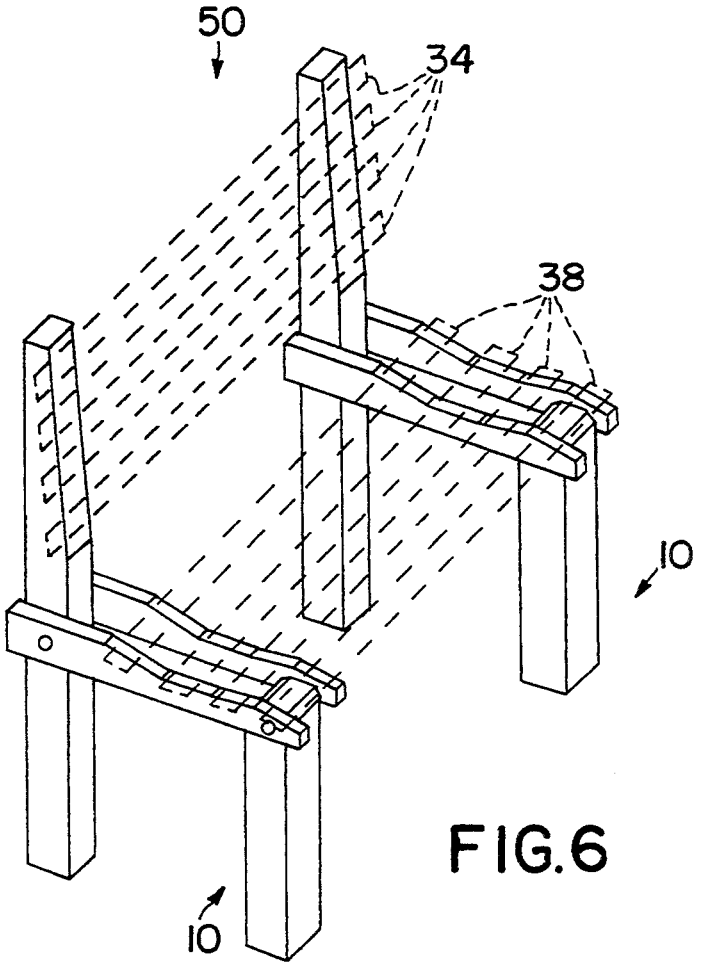
FIG. 6 is a perspective view of the bench of FIG. 5.
Figure 7:
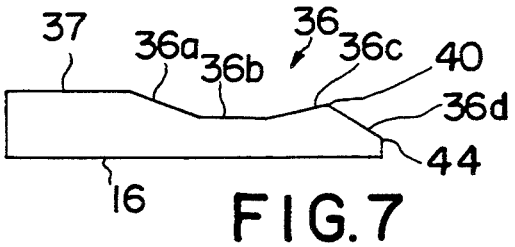
FIG. 7 is an enlarged side elevation of a horizontal component for seat brackets according to the invention
Figure 8:
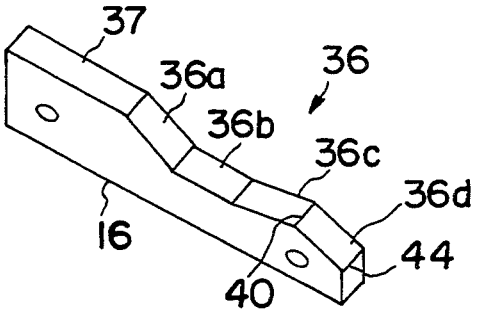
FIG. 8 is a perspective view of the horizontal component of FIG. 7.

A seat or bench 50 of any desired length may be assembled from two or more seat brackets 10 as illustrated in FIGS. 5 and 6. A seat back is formed by fitting a plurality, preferably four, back slats 34 to the beveled section of the rear uprights of suitably spaced seat brackets. In a preferred form of the invention, the back slats comprise four evenly spaced 2 by 4's attached to the beveled surfaces by suitable fasteners such as hi-thread zinc screws. The bench is completed by securing four seat slats, one to each of the sections 36 *a–d* of the compound seat surface 36. The seat slats preferably are 2 by 4 planks secured by hi-thread zinc screws or other suitable fasteners. A bench according to the invention may be of varying length as for example 2, 4, 6, 8 foot lengths form standard lumber components and having two or more seat brackets as necessary to provide suitable support over the full length of the bench. An armrest 46 may be fitted to both ends of a bench.

A completed bench according to the invention is primarily suited for outdoor use as on a porch or patio as well as in places of public accommodation such as parks, restaurants, campgrounds and so forth with seat components custom fitted for particular installations.

I claim:

1. A seat bracket for assembling a bench comprising a front upright member and a rear upright member with the front upright member being approximately one-half the height of the rear upright member, the rear upright member having an upper forwardly facing surface beveled to form an upward and rearward inclined surface for receiving back slats of an assembled bench, the front and rear upright members being joined by a pair of seat support crosspieces fastened to the midpoint of the rear upright member and to the top of the front upright member, each seat support crosspiece having a compound surface contour from rear to front for receiving seat slats and for providing an orientation of the seat slats so as to provide a comfortable seat.

2. A seat bracket as defined in claim 1 in which each compound surface extends from the top surface of the seat support crosspiece and includes a first forwardly and downwardly inclined section, a second central generally horizontal section, a third forwardly and upwardly inclined section, and terminates in a fourth forwardly and downwardly inclined section.

3. A seat bracket as defined in claim 2 in which the top surface of the seat support crosspiece defines a first level and the second central generally horizontal section defines a second level, and in which third and fourth sections form a peak located approximately midway between the first level and the second level.

4. A seat bracket as defined in claim 3 in which the terminal section ends at a point below the second level.

5. A bench comprising at least two seat brackets with each seat bracket comprising a front upright member and a rear upright member with the front upright member being approximately one-half the height of the rear upright member, the rear upright member having an upper forwardly facing surface beveled to form an upward and rearward inclined surface for receiving back slats, the front and rear upright members being joined by a pair of seat support crosspieces fastened to the midpoint of the rear upright member and to the top of the front upright member, each seat support crosspiece having a compound surface contour from rear to front for receiving seat slats and for providing an orientation of the seat slats so as to provide a comfortable seat, the seat brackets set apart in aligned relationship for receiving back slats and seat slats, a plurality of back slats affixed to the beveled section of the rear uprights, and a plurality of seat slats affixed to the compound surface of the crosspieces of each bracket.

6. A bench as defined in claim 5 in which a seat slat occupies substantially the full width from front to rear of each section of the crosspiece compound surfaces.

7. A bench as defined in claim 6 in which four back slats define a back rest, and four seat slats define a bench seat.

8. A bench as defined in claim 6 in which the beveled surface of each upright member of the seat brackets is inclined approximately 10 degrees rearwardly from the vertical.

* * * * *